US007892066B2

(12) United States Patent
Kelley

(10) Patent No.: US 7,892,066 B2
(45) Date of Patent: Feb. 22, 2011

(54) BUBBLE GENERATING HULA HOOP

(76) Inventor: Joseph M. Kelley, 1321 E. Broad St., Westfield, NJ (US) 07090

( * ) Notice: Subject to any disclaimer, the term of this patent is extended or adjusted under 35 U.S.C. 154(b) by 125 days.

(21) Appl. No.: 10/983,253

(22) Filed: Nov. 4, 2004

(65) Prior Publication Data

US 2006/0094324 A1 May 4, 2006

(51) Int. Cl.
*A63H 33/28* (2006.01)
*A63H 33/02* (2006.01)
*A63H 33/00* (2006.01)

(52) U.S. Cl. ..... 446/236; 446/15; 446/267

(58) Field of Classification Search ..... 446/267, 446/236, 15–21, 475
See application file for complete search history.

(56) References Cited

U.S. PATENT DOCUMENTS

| | | | | | |
|---|---|---|---|---|---|
| 1,259,889 | A | | 3/1918 | MacDonald | |
| 2,514,069 | A | | 7/1950 | Raspet | |
| 2,720,723 | A | | 10/1955 | Peretti | |
| 2,738,616 | A | * | 3/1956 | Windle | 446/267 |
| 2,928,205 | A | | 3/1960 | Fulton | |
| 2,946,152 | A | | 7/1960 | Rubin | |
| 3,123,936 | A | | 3/1964 | Feltman | |
| 3,178,851 | A | | 4/1965 | Gage | |
| 3,326,551 | A | * | 6/1967 | Clarke | 482/81 |
| 3,345,772 | A | | 10/1967 | Sam | |
| 3,398,479 | A | * | 8/1968 | Rave | 446/21 |
| 3,630,951 | A | | 12/1971 | Wetherly | |
| 3,745,693 | A | | 7/1973 | La Fata | |
| 4,152,864 | A | | 5/1979 | Habison | |
| 4,215,510 | A | | 8/1980 | Worrell | |
| 4,380,885 | A | | 4/1983 | Komagata | |
| 5,102,381 | A | | 4/1992 | Danielak | |
| 5,452,747 | A | * | 9/1995 | De Man | 137/885 |
| 5,480,336 | A | * | 1/1996 | Blanchard | 446/89 |
| 5,603,651 | A | | 2/1997 | Shure | |
| 5,823,846 | A | | 10/1998 | Arriola | |
| 5,895,309 | A | | 4/1999 | Spector | |
| 6,059,632 | A | | 5/2000 | Sassak | |
| 6,384,089 | B1 | | 5/2002 | Tomida | |
| 6,431,939 | B1 | * | 8/2002 | Roh et al. | 446/236 |
| 6,450,854 | B1 | | 9/2002 | Fireman | |
| 6,482,136 | B1 | * | 11/2002 | Kessler | 482/110 |
| 6,494,760 | B1 | * | 12/2002 | Kessler | 446/236 |
| 6,547,621 | B1 | | 4/2003 | Cameron | |
| 6,593,375 | B2 | | 7/2003 | Ammon, Jr. | |
| 6,890,238 | B2 | * | 5/2005 | Kessler | 446/236 |
| 2003/0228829 | A1 | * | 12/2003 | Falk | 446/475 |

* cited by examiner

*Primary Examiner*—Gene Kim
*Assistant Examiner*—Urszula M Cegielnik
(74) *Attorney, Agent, or Firm*—Margaret B. Kelley

(57) ABSTRACT

A hoop suitable for producing bubbles is constructed by forming an arcurate hollow loop by a connector, filling the hoop with a low surface tension liquid, feeding the liquid through a channel in the connector to a film forming element. The film is removed by an air flow through the film forming element to form a bubble. The liquid is moved through the hoop and into the film forming element by centrifugal force and subsequently removed by an air flow through the film forming element caused by rotation of the hoop by gyration of the hips.

4 Claims, 1 Drawing Sheet

BUBBLE GENERATING HULA HOOP

BACKGROUND OF THE INVENTION

In the 1950's, linear polyethylene had desirable extrusion and stiffness properties to produce an arcurate hoop used by millions as a toy or exercise aid, spinning the hoop by gyration of the hips. Variations upon this theme led to filling of the hollow hoop with liquids (see U.S. Pat. No. 2,738,616 issued Mar. 20, 1956 to M. D. Windle) or small balls for noise (see U.S. Pat. No. 2,946,152 issued Jul. 26, 1960 to L. R. Rubin) and/or decorating the outside with decorations or lights.

Even before the advent of these hoops, bubble emitting devices were described by forming a film and then disengaging the film with air to form a bubble. These devices are described in the prior art.

It would be desirable to provide a toy hoop which is capable of producing bubbles.

SUMMARY OF THE INVENTION

A bubble-generating toy or exercise hoop is constructed using at least one hollow loop having terminal ends which are coupled together by a hollow connector to form a circular hollow hoop. The hollow connector has at least one opening which is suitable for both introducing a film-forming liquid into the hollow hoop to partially fill the hoop and for forming a film over film-forming element. Bubbles are formed by displacing the film with air when the hoop is rotated.

Also available is a modification of this invention which will retrofit an existing hula hoop to one capable of forming bubbles when rotated around the hips. The kit consists of directions for or a means of cutting a hollow hoop into at least two ends and a connector for rejoining the two ends. The connector contains a means for adding the film-forming liquid and a film-forming device to produce a thin film which is subsequently removed by air flow as a bubble. Alternately, the film-forming liquid may be added through a single opening, which is then fitted with a film-forming device such as a ring.

DESCRIPTION OF THE INVENTION

Figure 1:
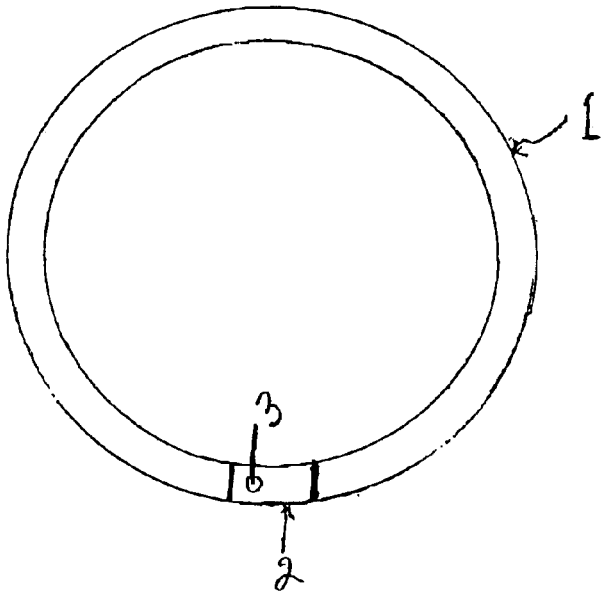
FIG. 1 is a circular, hollow loop (1), the ends of which are joined by a connector (2) having at least one opening (3) where bubble forming liquid may be added. The opening (3) may also discharge a film which forms bubbles when the hoop is rotated.
Figure 2:
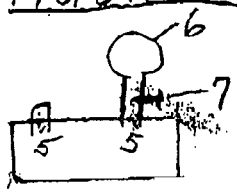
FIG. 2 is a hollow connector (4) which has two openings (5) which are used to add the bubble forming liquid and attaches the film forming element (6). The flow of film-forming liquid to (6) is controlled by a set screw (7) which can be adjusted to give the optimum flow of film-forming liquid.
Figure 3:
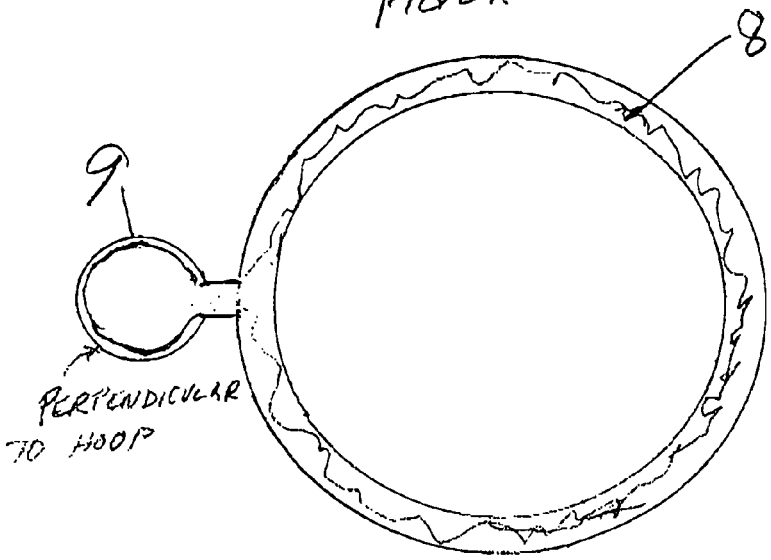
FIG. 3 is a hollow hoop, partially filled with film-forming liquid (8). The hoop is equipped with a film-forming bubble diffuser (9) in its outer surface of the hoop.

In the embodiment shown in FIG. 1, the hoop is formed of a circular loop (1) having a hollow annular space and terminal ends. The ends are coupled together by a hollow connector (2) to form a substantially circular hollow loop. The hollow connector (2) has at least one opening (3) which is suitable for both introducing a low surface tension film-forming fluid, having the desired capillary action, into the hollow hoop to partially fill the hoop and form a film when rotated. The air flow produced by rotation of the hoop dislodges and forms a series of bubbles. In the embodiment shown in FIG. 2, hollow connector (4) has both an inlet (5) for introducing the film forming liquid and an outlet (6) where a film is formed when a partially liquid-filled hoop is rotated. Preferably, the film-forming outlet (6) is equipped with a set screw (7) or other means for controlling the flow of the bubble forming liquid into the film-forming element. In the embodiment shown in FIG. 3, a hollow substantially circular loop (8) is partially filled with a film forming liquid where there is a bubble diffuser outlet (9) in its exterior surface. The film forming element is positioned perpendicular to the air flow. The film is displaced with air when the hoop is rotated around the body e.g., by gyration of the hips. Optionally, a separate inlet (6) is provided for the introduction of the bubble-forming liquid.

Additionally, the circular hoop having a hollow closed body with a curved outer wall is equipped with an inlet capable of adding liquid solutions to the interior annular space of the hoop. The fluid liquid material tends to stabilize and brake and maintain uniform angular velocity of the hoop. The hoop or the connector has a small opening so small amounts of the liquid can be discharged to the film-forming element and form a film which is discharged from the opening in the form of a bubble when the hoop is rotated and the air flow through the opening removes the film. Multiple film-forming elements may also be included in the hoop for forming a large number of bubbles. Preferably, the film-forming element consists of a ring which aids in the formation of the film.

The film-forming element can be any configuration capable of forming a film. Preferably, it is located on the connector(s) and it is interchangeable with other film-forming elements so that bubbles of various sizes can be produced. The geometry of the film-forming element (2) may be circular, triangular, or square. The film-forming element (2) may have multiple elements. Preferable, the film-forming element (2) contains a groove throughout the circumference to promote film formation. examples of bubble diffusers and film-forming elements are disclosed in U.S. Pat. Nos. 3,745,693 and 4,152,864, the disclosures of which are incorporated herein by reference.

The inlet valve for the film forming liquid comprises, for example, a soft rubber element capable of being penetrated by a needle through which the film-forming liquid is introduced and may be located on the connector or some other place on the loop.

Variations of the above hoop include multiple hollow loops where the terminal end of each loop is connected with another loop by the hollow connectors. Multiple sections may be connected to form a large hoop producing a large number of bubbles. Alternatively, each section may be isolated by a barrier and filled with a different color bubble-forming liquid, producing multi-colored bubbles. Likewise, if multiple circular loops are incorporated in the hoop and at least one is isolated from another loop, then at least one inlet and outlet is included in each loop. Fragrances may also be added to the bubble-forming liquid(s).

The annular space(s) of the hoop are filled about ½ to ¾ full with a bubble-forming liquid having a low surface tension and good capillary action such as the liquids commonly used to generate bubbles. For example, children's toys are sold with liquid formulations for generating bubbles using a ring to form films and generate bubbles. The liquid also serves to stabilize the hoop during use, making it easier to keep the hoop suspended during rotation around the body e.g., the waist or the wrist.

The bubble-forming liquid may be an aqueous composition ranging from simple solutions comprising about 0.05 to about 25.0% of a detergent or the composition disclosed in U.S. Pat. No. 3,630,951, the disclosure of which is incorporated herein by reference. The composition of the '951 patent provides long lasting, pendulous bubbles having a 20 to 90 minute duration. The liquid composition comprises 0.75 wt. % each of C8F17SO2NHC3H6N(CH3)3I and C7F15CONHC3H6N(CH3)2C2H4CO2, 1.47% Polyox WSR-35 (Union Carbide), 25% USP Glycerin, and 72.1% water by weight.

Another aqueous bubble-forming liquid is described in U.S. Pat. No. 6,384,089, the disclosure of which is incorporated herein by reference. The liquid consists essentially of an emulsifier which is an ester of a C8-C14 fatty acid with a polyhydric alcohol, a thickener derived from plants and a sweetener such as sucrose.

The rotation of the hoop in the usual manner by whirling the hoop around the waist by movement of the hips provides the centrifugal force to feed the bubble-forming liquid into the outlet or bubble diffuser(s) where the film is formed and from which the bubbles are immediately discharged. The rotation of the hoop generates an air flow through the partially filled hoop and causes the film to be discharged as a bubble.

In addition, small stainless balls slightly smaller than the cross section of the hoop can be placed inside the hoop to provide noise. The balls also pump the bubble-forming liquid to the outlet(s) or bubble diffusers under more pressure than the centrifugal force of the rotating hoop alone. The bubble diffuser may be extended a distance from the hoop by a tube extension to produce bubbles away from the user.

Variations on these ideas are possible, such as varying the size and/or diameter of the hoop, the color of the hoop, the color of the liquid, the size and geometry of bubble-forming outlet, adding lights and/or musical elements, and including a fragrance in the bubble-forming liquid etc. Additionally, hoops having a smaller circumference can be used on a person's arms, legs, neck, wrist or ankle.

What is claimed is:

1. A kit for converting a hula hoop into a bubble-generating hula hoop comprises:

(a) a device for cutting a hollow hula hoop into one or more hollow loop(s) having terminal ends;

(b) one or more hollow connector(s) for coupling the terminal ends of the hollow loop(s) together into a substantially circular hoop, wherein the connector(s) have at least one opening which is used for introducing film-forming liquid(s) into the hollow hoop;

(c) closed container(s) containing film-forming liquid(s);

(d) one or more means for removing the film-forming liquid(s) from the container(s) and for introducing the film-forming liquid(s) into the connector(s); and (e) instructions:

(i) for cutting the hula hoop into hollow loop(s) having terminal ends;

(ii) for connecting the terminal ends of the hollow loop (s) with the hollow connector(s) to reassemble the hula hoop;

(iii) for partially filling the reassembled hula hoop with the film-forming liquid(s); and (iv) for generating bubbles by rotating the partially liquid-filled, reassembled hula hoop.

2. A kit useful for assembling a bubble-generating hoop comprises:

(a) hollow loop(s) having terminal ends and hollow connector(s), wherein the loop(s) and/or the connector(s) have opening(s) in the outer surface(s)thereof;

(b) closed container(s) containing film-forming liquid(s);

(c) one or more means for withdrawing the film-forming liquid(s) from the container(s); and (d) instructions:

(i) for connecting the terminal ends of the hollow loop(s) with the hollow connector(s) to form a substantially circular hollow hoop;

(ii) for withdrawing the film-forming liquid(s) from the container(s) and introducing the film-forming liquid (s) into the opening(s) in the outer surface(s) of the hollow loop(s) and/or the hollow connector(s); and (iii) for rotating the partially liquid-filled hoop to form film(s) and generate bubble(s) from the opening(s).

3. A kit useful for assembling a bubble-generating hoop comprises:

(a) a hollow, substantially circular hoop having opening(s) in the outer surface thereof;

(b) closed container(s) containing film-forming liquid(s);

(c) one or more means for withdrawing the film-forming liquid(s) from the container(s);

(d) film-forming element(s) for insertion into the opening (s) in the outer surface of the hoop; and (e) instructions;

(i) for withdrawing the film-forming liquid(s) from the container(s);

(ii) for introducing the film-forming liquid(s) into the opening(s) in the outer surface of the hoop;

(iii) for inserting the film-forming element(s) into the opening(s) in the outer surface of the partially liquid-filled hoop; and (iv) for rotating the partially liquid-filled hoop to generate bubble(s) from the film-forming element(s).

4. The kit of claim 3, wherein the film-forming element(s) are bubble-diffuser(s) and/or ring(s).

* * * * *